US011206874B2

(12) United States Patent
Yaremenko

(10) Patent No.: US 11,206,874 B2
(45) Date of Patent: Dec. 28, 2021

(54) ADJUSTABLE STRAPS FOR A GARMENT

(71) Applicant: LULULEMON ATHLETICA CANADA INC., Vancouver (CA)

(72) Inventor: Yuliya Victorivna Yaremenko, Vancouver (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 177 days.

(21) Appl. No.: 16/667,057

(22) Filed: Oct. 29, 2019

(65) Prior Publication Data

US 2020/0237026 A1 Jul. 30, 2020

Related U.S. Application Data

(60) Provisional application No. 62/798,313, filed on Jan. 29, 2019.

(51) Int. Cl.
*A41C 3/00* (2006.01)

(52) U.S. Cl.
CPC ..... *A41C 3/0028* (2013.01)

(58) Field of Classification Search
CPC ..... A41C 3/0028
USPC ..... 450/86
See application file for complete search history.

(56) References Cited

U.S. PATENT DOCUMENTS 2,870,768 A * 1/1959 Robinson ..... A41F 15/00 450/86
3,935,865 A * 2/1976 Newmar ..... A41C 3/0078 450/64
8,075,369 B2 * 12/2011 Hendrickson ..... A41C 3/04 450/86

(Continued)

OTHER PUBLICATIONS

Queenieke, "Women's Light Support Double-T Back Wirefree Pad Yoga Sports Bra", posted 2019 [online], retrieved Mar. 9, 2020. Retrieved from the Internet: https://www.amazon.com/Queenie-Ke-Support-Double-T-Wirefree/dp/B0732W8ZBT/ref=pd_di_sccai_2/140-2395075-4176949?_encoding=UTF8&pd_rd_i=B07S4NMBDP&pd_rd_(Year 2019).

(Continued)

*Primary Examiner* — Gloria M Hale
(74) *Attorney, Agent, or Firm* — Conneely PC; Joseph Conneely

(57) ABSTRACT

Straps for a garment, the garment having a body for covering at least a portion of a chest of a wearer, the straps comprising: at least one neck strap connected to an upper part of the body forming a neck opening; at least one back strap attached to the body forming a torso opening; and, at least one pair of adjustable straps each arm of the pair of adjustable straps having a lower end that is attached to the at least one back strap on either side of a midpoint thereof on a back of the garment and an upper end attached to the at least one neck strap, wherein the at least one pair of adjustable straps further comprise sliding means formed at the upper end such that the adjustable straps are slidable on either side of a midpoint of the neck strap, and wherein the second ends of the at least one pair of the adjustable straps are slidable along the neck strap between respective first positions proximate the midpoint of the neck strap and second positions proximate the body of the garment to adjust the fit of the garment across the upper back of the wearer and to adjust a spacing between the neck strap and the back strap.

6 Claims, 17 Drawing Sheets

(56) References Cited

U.S. PATENT DOCUMENTS

| | | | | |
|---|---|---|---|---|
| D759,942 | S | 6/2016 | Martz | |
| D765,947 | S | 9/2016 | McManus | |
| D786,531 | S | 5/2017 | Holmes | |
| D798,536 | S | 10/2017 | Holmes | |
| D805,730 | S | 12/2017 | Lorett | |
| D811,040 | S | 2/2018 | Pornillos | |
| D816,942 | S | 5/2018 | Holmes | |
| D857,335 | S | 8/2019 | Holmes | |
| 2008/0113587 | A1* | 5/2008 | Richardson | A41C 3/0021 450/58 |
| 2009/0126084 | A1* | 5/2009 | Fenske | A41C 3/02 2/338 |
| 2009/0270013 | A1* | 10/2009 | Clair | A41C 3/08 450/30 |
| 2015/0208735 | A1* | 7/2015 | Buescher | A41C 3/12 450/86 |
| 2017/0273365 | A1 | 9/2017 | Muhlenfeld | |

OTHER PUBLICATIONS

Lululemon, "Free To Be Wild Strappy Sports Bra", posted 2018 [online], retrieved Mar. 9, 2020. Retrieved from the Internet: https://www.amazon.com/Lululemon-Free-Strappy-Sports-Black/dp/B01BQUOAI0/ref=pd_sbs_200_1/140-2395075-4176949?_encoding=UTF8&pd_rd%E2%80%A6 (Year: 2018).

* cited by examiner

ADJUSTABLE STRAPS FOR A GARMENT

This application claims priority from and the benefit of the filing date of U.S. Provisional Patent Application No. 62/798,313, filed Jan. 29, 2019, and the entire content of such application is incorporated herein by reference.

FIELD OF THE APPLICATION

This application relates to the field of sports apparel, and more specifically, to adjustable straps for a garment such as a bra, tank top, or bathing suit.

BACKGROUND OF THE APPLICATION

Consumers are demanding high performance activewear and sportswear. This is especially so for garments used for running, yoga, and swimming such as bras, tank tops, and bathing suits. Such garments should be as supportive as possible but must still be flexible to keep a wearer comfortable during stretching, exercising, and other athletic performance.

One problem with existing straps for bras and similar garments is that they often do not adequately adjust to the shape of the wearer's body. These straps may be difficult or time consuming to adjust. In addition, such straps often include buckles or hasps that may become uncomfortable for a wearer then the wearer is engaged in stretching, exercising, swimming, and athletic performance.

A need therefore exists for improved adjustable straps for a garment. Accordingly, a solution that addresses, at least in part, the above and other shortcomings is desired.

SUMMARY OF THE APPLICATION

According to one aspect of the application, there are provided straps for a garment, the garment having a body for covering at least a portion of a chest of a wearer, the straps comprising: at least one neck strap connected to an upper part of the body forming a neck opening; at least one back strap attached to the body forming a torso opening; and, at least one pair of adjustable straps each arm of the pair of adjustable straps having a lower end that is attached to the at least one back strap on either side of a midpoint thereof on a back of the garment and an upper end attached to the at least one neck strap, wherein the at least one pair of adjustable straps further comprise sliding means formed at the upper end such that the adjustable straps are slidable on either side of a midpoint of the neck strap, and wherein the second ends of the at least one pair of the adjustable straps are slidable along the neck strap between respective first positions proximate the midpoint of the neck strap and second positions proximate the body of the garment to adjust the fit of the garment across the upper back of the wearer and to adjust a spacing between the neck strap and the back strap.

According to another aspect of the application, there are provided straps for a garment, the garment having a body for covering a portion of the chest of a wearer, the straps comprising: a neck strap extending between first and second sides of a top edge of the body for securing the body around the neck of the wearer; a back strap extending between first and second lower side edges of the body for securing the body around the lower back of the wearer; at least one pair of adjustable straps attached at respective lower ends to the back strap on either side of a midpoint thereof on a back of the garment and slidably attached at respective upper ends to the neck strap on either side of a midpoint thereof on the back of the garment, wherein the upper ends of the first pair of adjustable straps are slidable along the neck strap between respective first positions proximate the midpoint of the neck strap and second positions proximate the body of the garment to adjust the fit of the garment across the upper back of the wearer and to adjust a spacing between the neck strap and the back strap.

According to another aspect of the applications, there is provided a garment, comprising: a body for covering a portion of the chest of a wearer; and, straps as described above for securing the body around the neck and across the back of the wearer.

According to another aspect of the application, there are provided adjustable straps for a garment, the garment having a body for covering a portion of the chest of a wearer, a neck strap extending between first and second sides of an upper edge of the body for securing the body around the neck of the wearer, and a back strap extending between first and second lower side edges of the body for securing the body around the lower back of the wearer, the adjustable straps comprising: a first pair of adjustable straps attached at respective lower ends to the back strap on either side of a midpoint thereof on a back of the garment and slidably attached at respective upper ends to the neck strap on either side of a midpoint thereof on the back of the garment, wherein the upper ends of the first pair of adjustable straps are slidable along the neck strap between respective first positions proximate the midpoint of the neck strap and second positions proximate the body of the garment to adjust the fit of the garment across the upper back of the wearer and to adjust a spacing between the neck and back straps; a first continuous adjustable strap attached between first and second portions thereof to the neck strap at the midpoint thereof on the back of the garment and slidably attached at respective lower ends of the first and second portions to the back strap on a first side of the midpoint thereof on the back of the garment, wherein the respective lower ends of the first and second portions are slidable along the back strap between respective first positions proximate the midpoint of the back strap and second positions proximate the body of the garment to adjust the fit of the garment across the lower back of the wearer and to further adjust the spacing between the neck and back straps; and, a second continuous adjustable strap attached between first and second portions thereof to the neck strap at the midpoint thereof on the back of the garment and slidably attached at respective lower ends of the first and second portions to the back strap on a second side of the midpoint thereof on the back of the garment, wherein the respective lower ends of the first and second portions are slidable along the back strap between respective first positions proximate the midpoint of the back strap and second positions proximate the body of the garment to adjust the fit of the garment across the lower back of the wearer and to further adjust the spacing between the neck and back straps.

BRIEF DESCRIPTION OF THE DRAWINGS

Features and advantages of the embodiments of the present application will become apparent from the following detailed description, taken in combination with the appended drawings, in which.

It will be noted that throughout the appended drawings, like features are identified by like reference numerals.

DETAILED DESCRIPTION OF EXAMPLE EMBODIMENTS

In the following description, details are set forth to provide an understanding of the application. In some instances, certain structures, techniques, and methods have not been described or shown in detail in order not to obscure the application.

Figure 1:
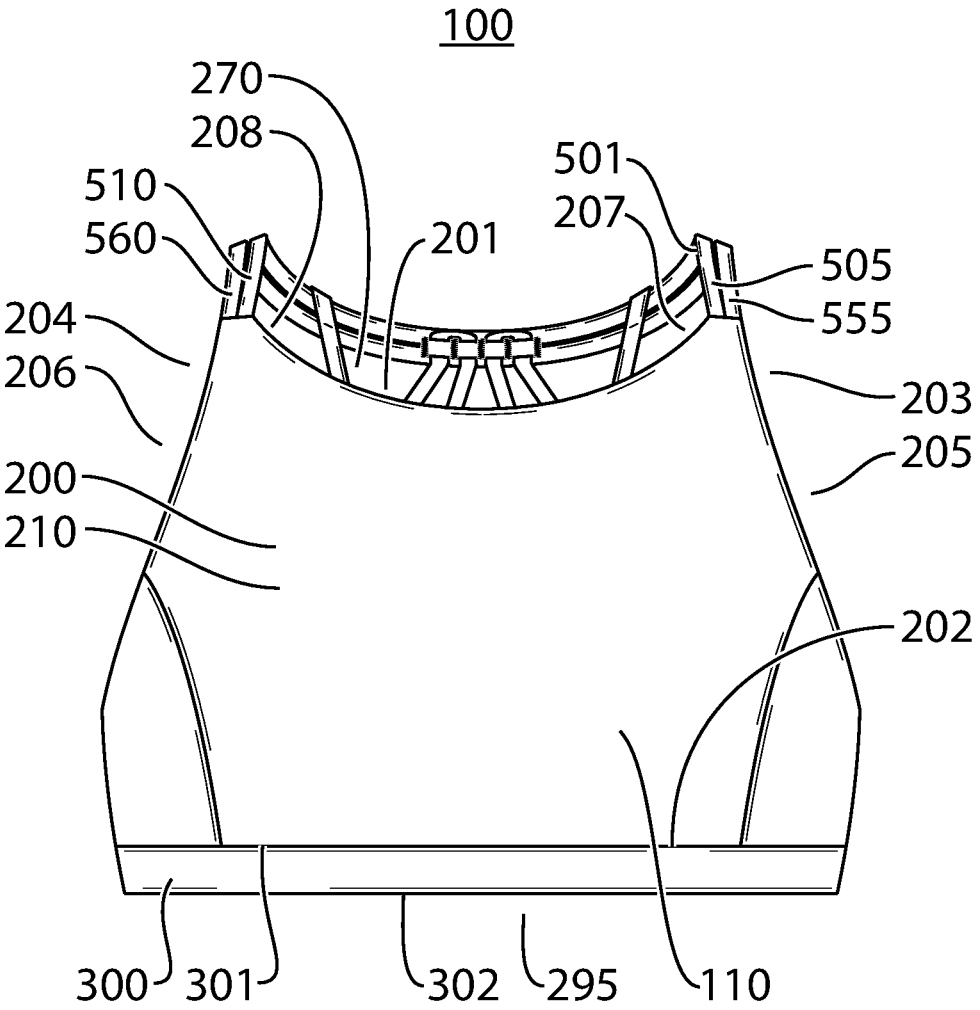
FIG. 1 is a front view illustrating an example of a garment in accordance with an embodiment of the application.
Figure 2A:
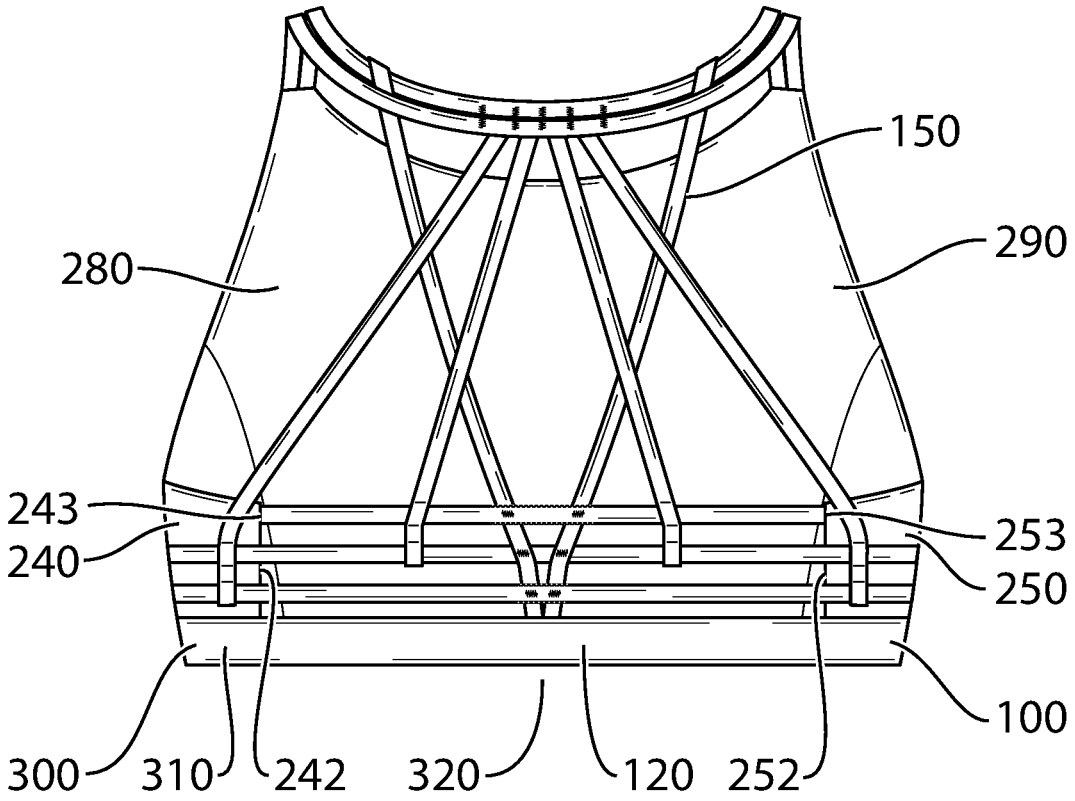
FIGS. 2A-2C show a rear view thereof with adjustable straps thereof shown in a partially extended position in accordance with an embodiment of the application.
Figure 2B:
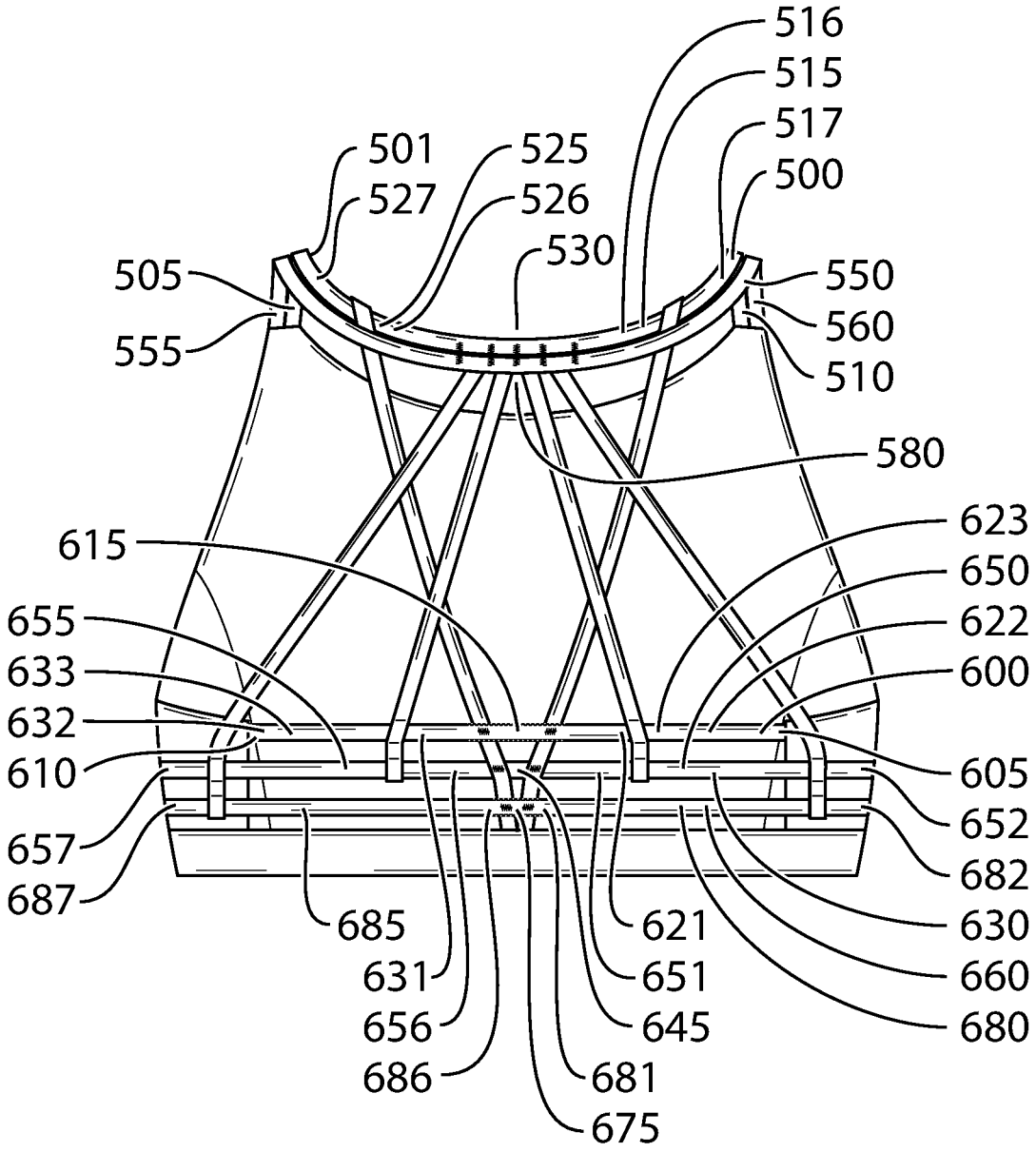
Figure 2C:
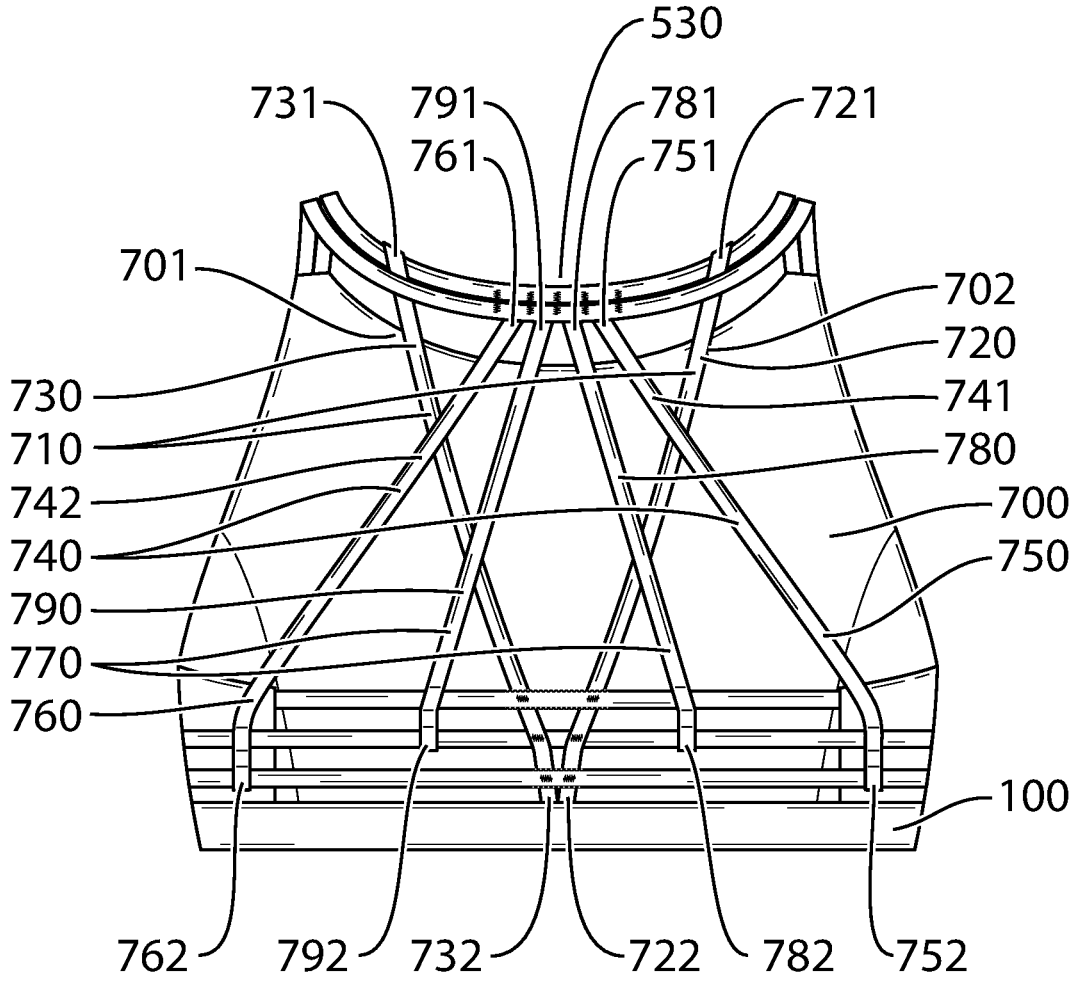
Figure 3:
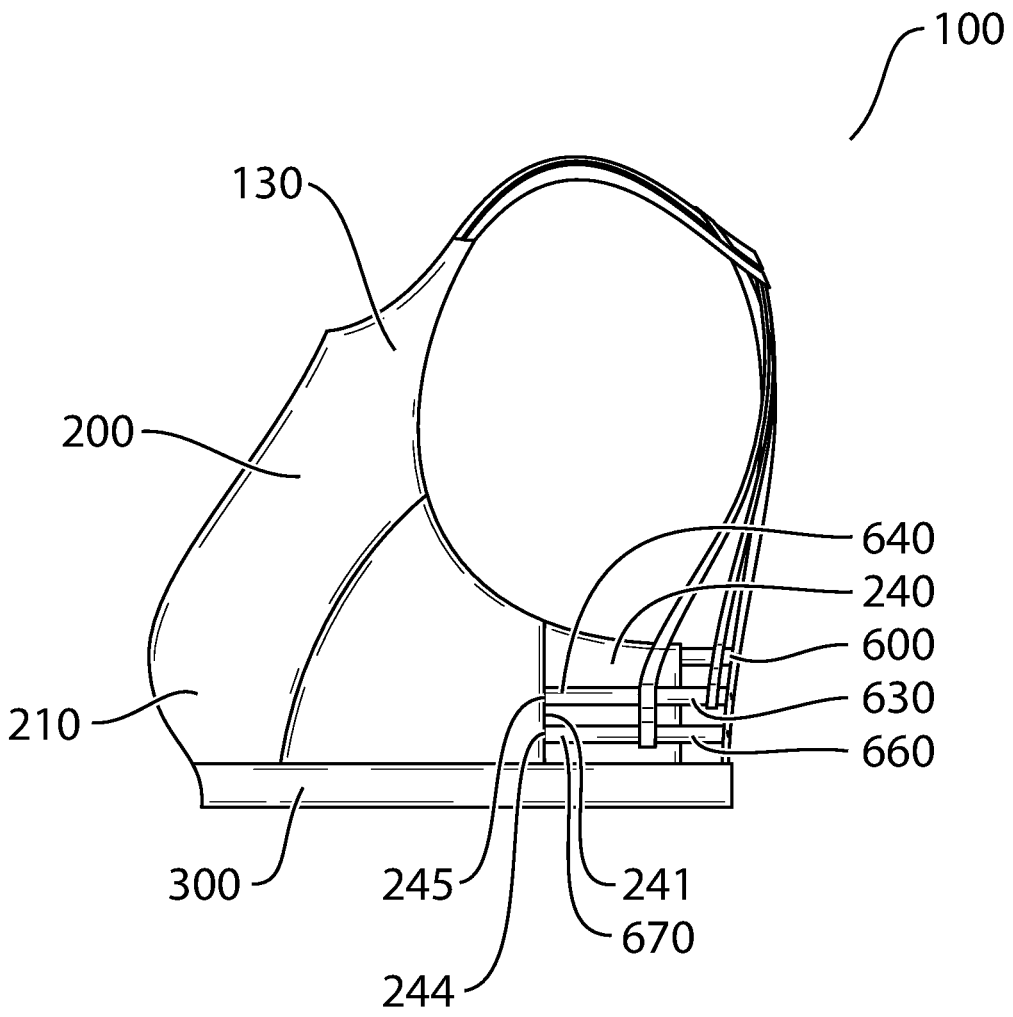
FIG. 3 is a right side view thereof.
Figure 4:
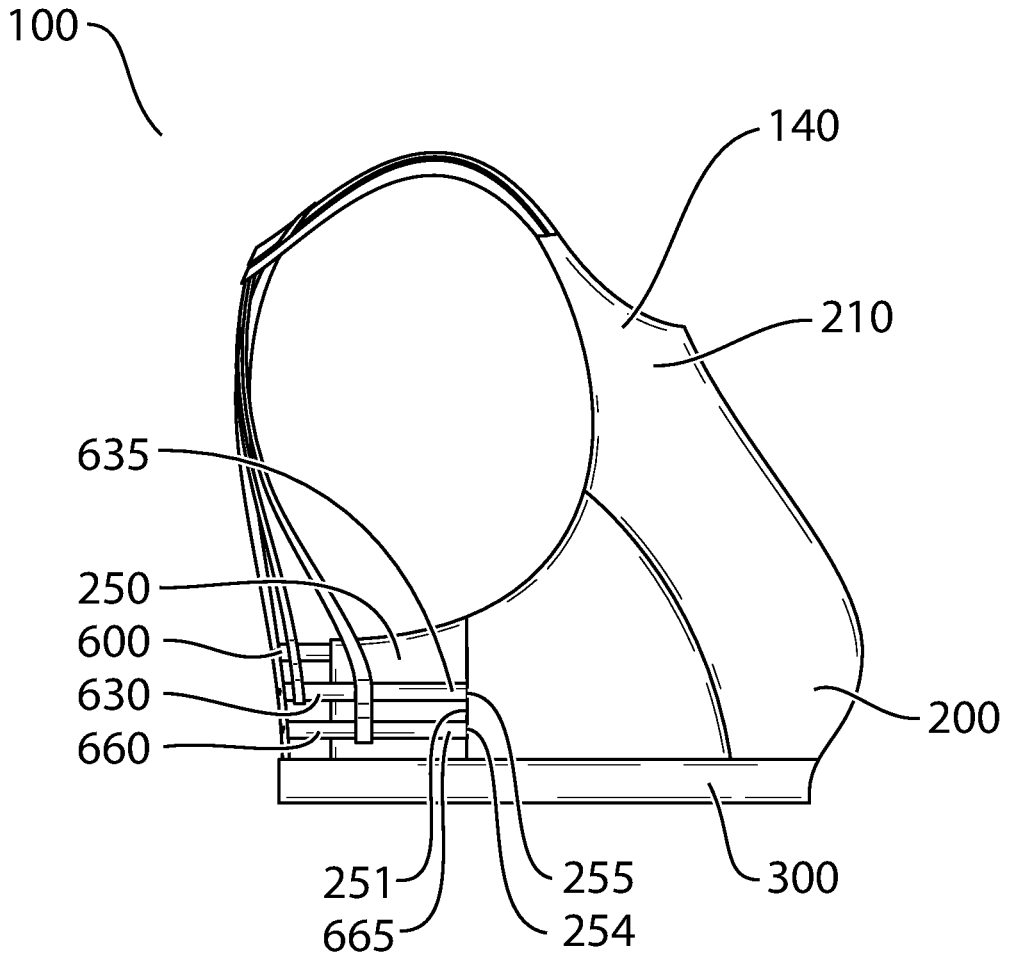
FIG. 4 is a left side view thereof.
Figure 5:
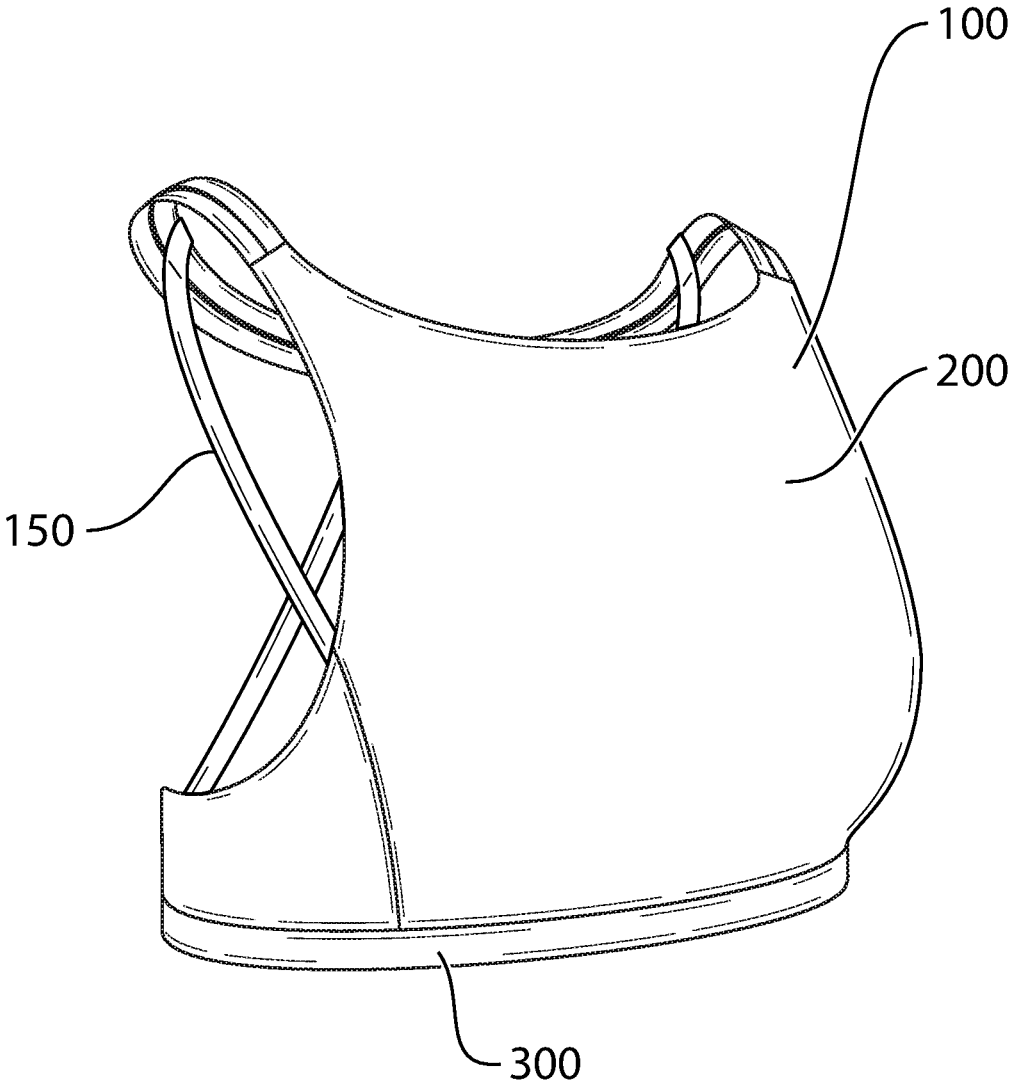
FIG. 5 is a front perspective view thereof.
Figure 6:
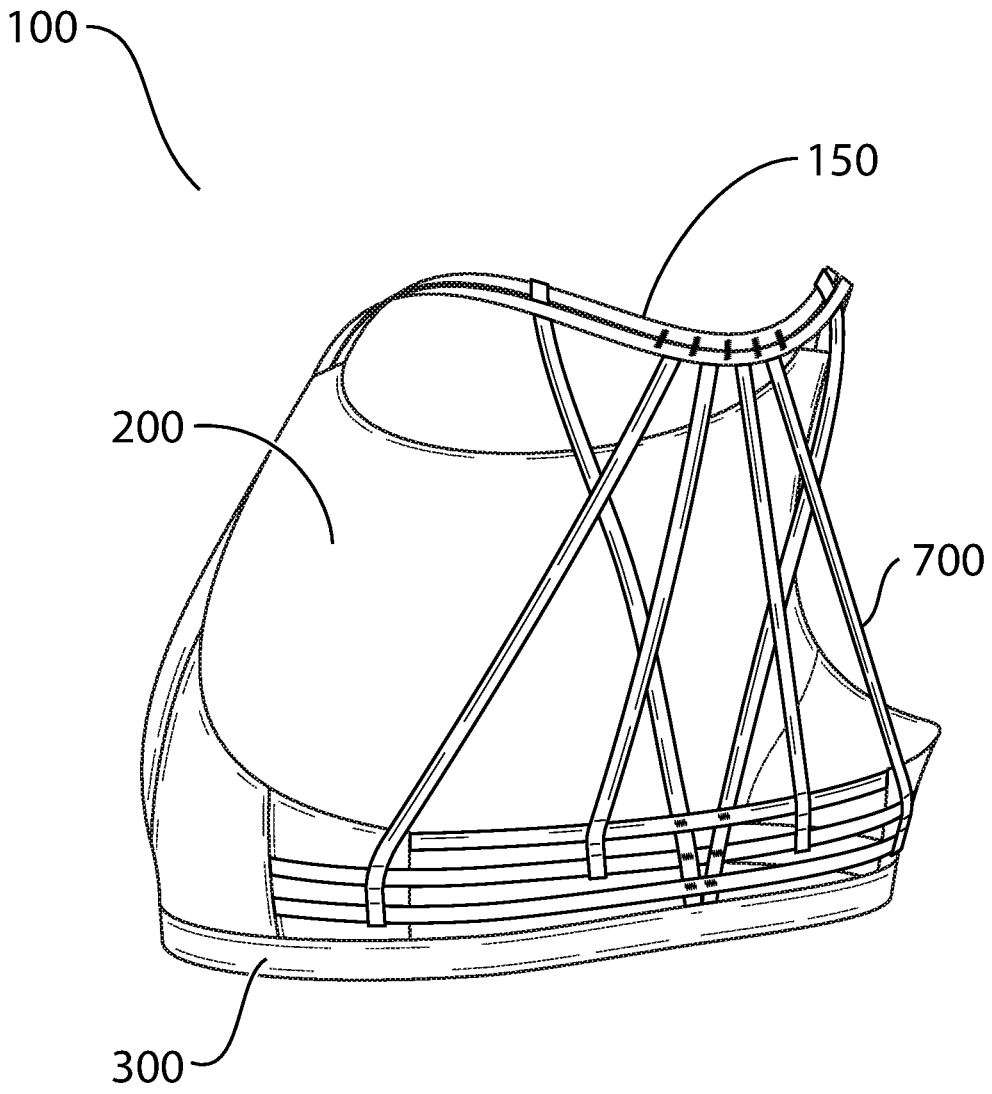
FIG. 6 is a rear perspective view thereof.
Figure 7:
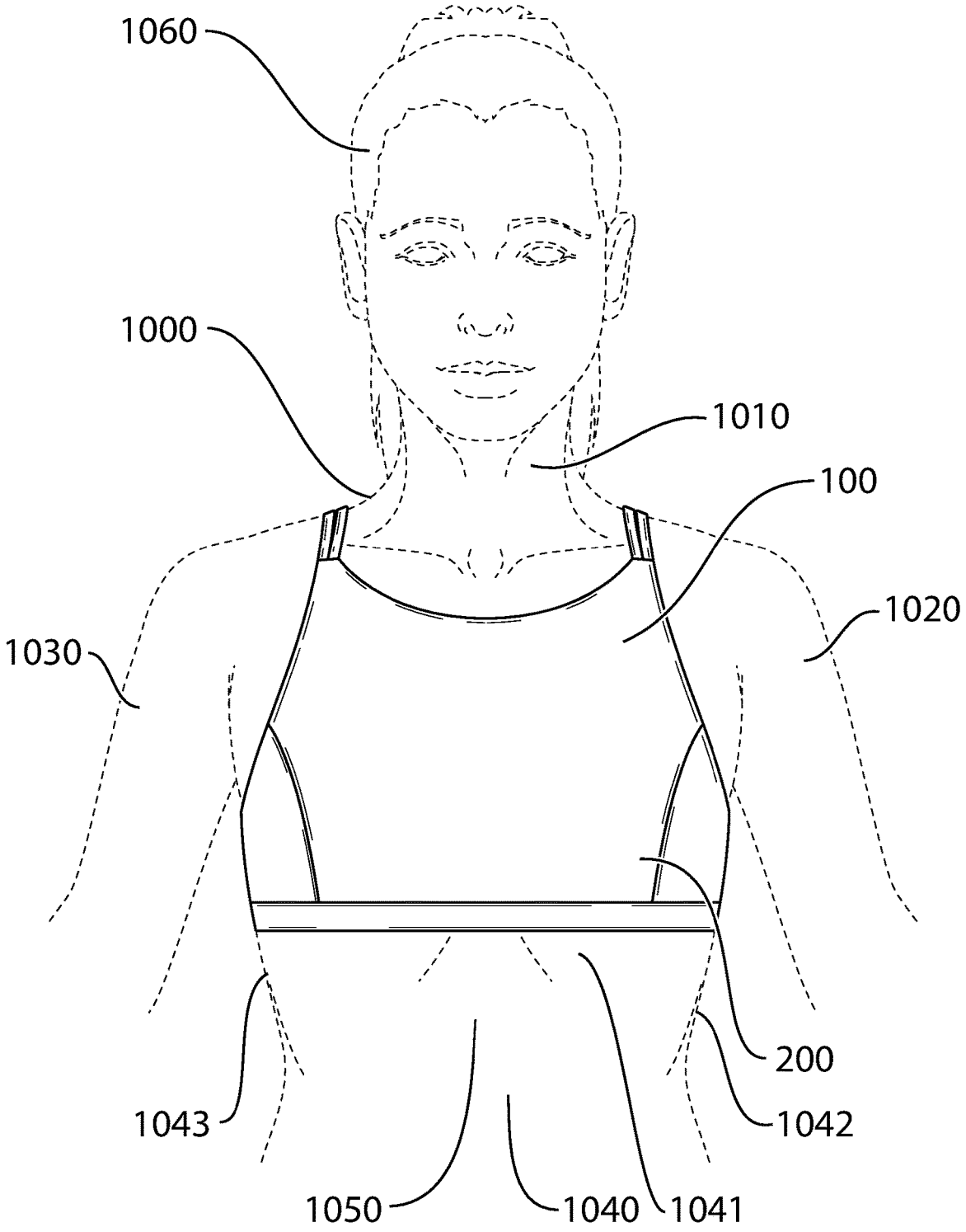
FIG. 7 is a front environmental view thereof illustrating the positioning of the garment on a wearer's body.
Figure 8:
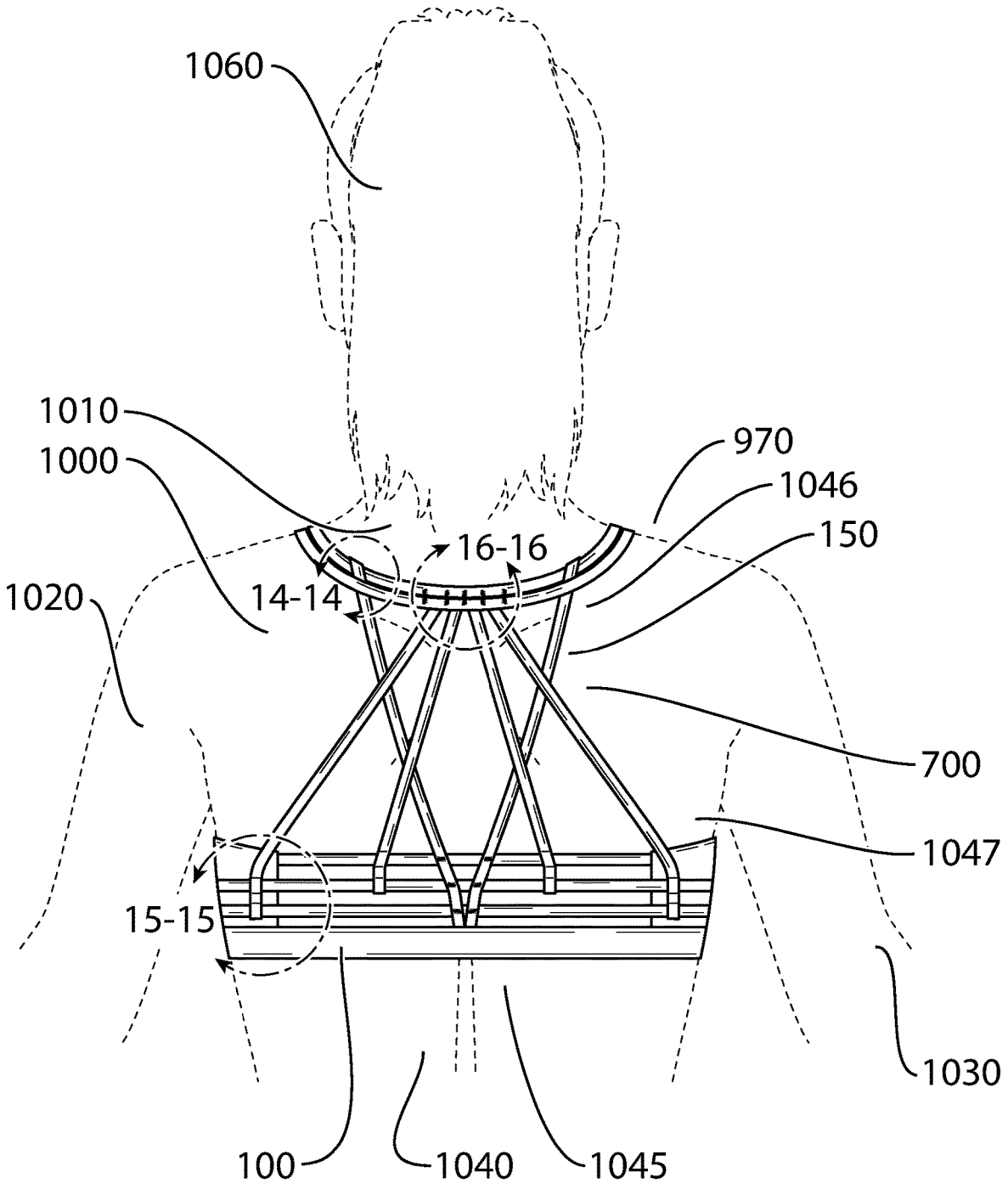
FIG. 8 is a rear environmental view thereof illustrating the positioning of the garment on a wearer's body.
Figure 9:
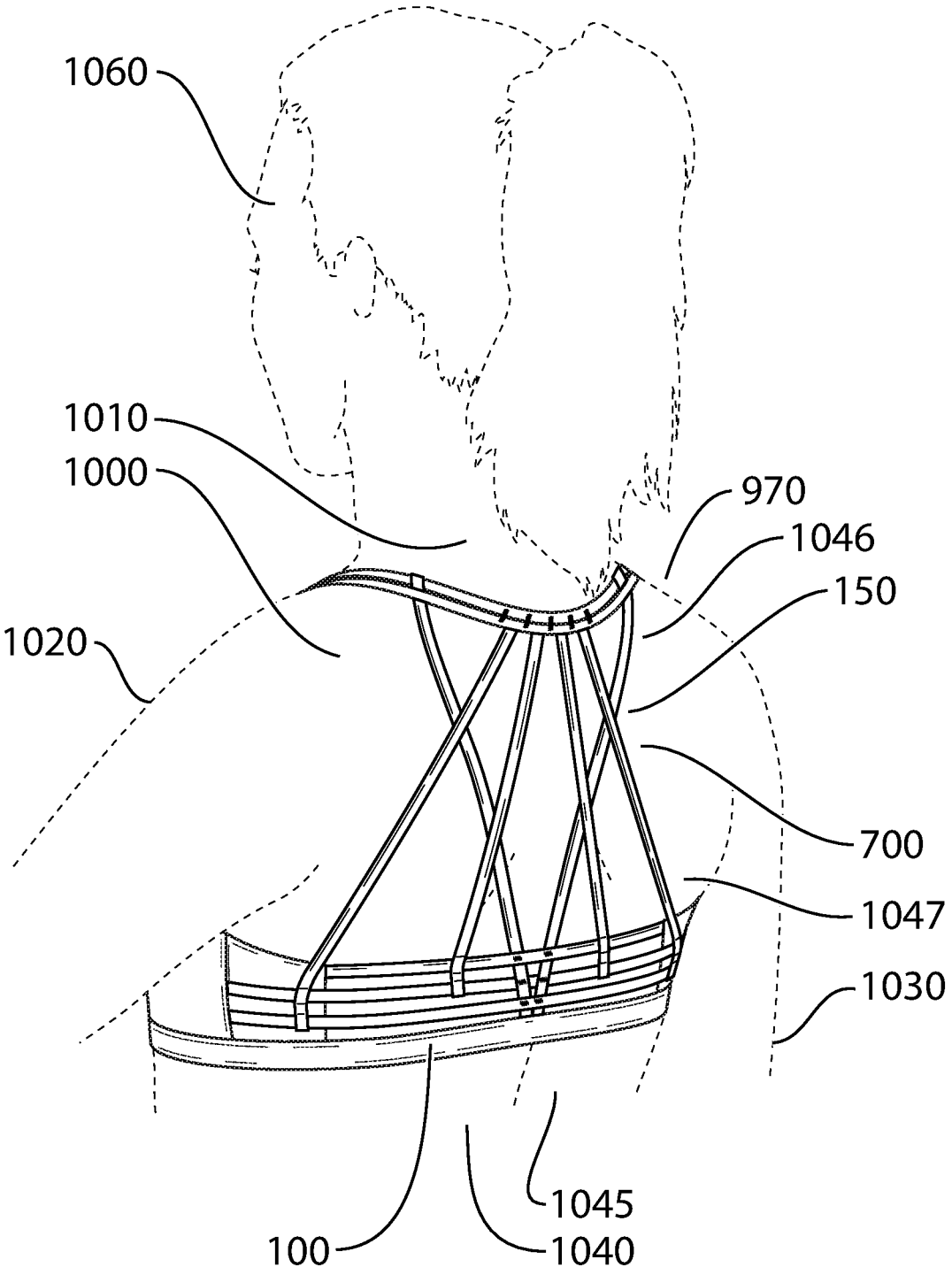
FIG. 9 is a rear perspective environmental view thereof illustrating the positioning of the garment on a wearer's body.
Figure 10:
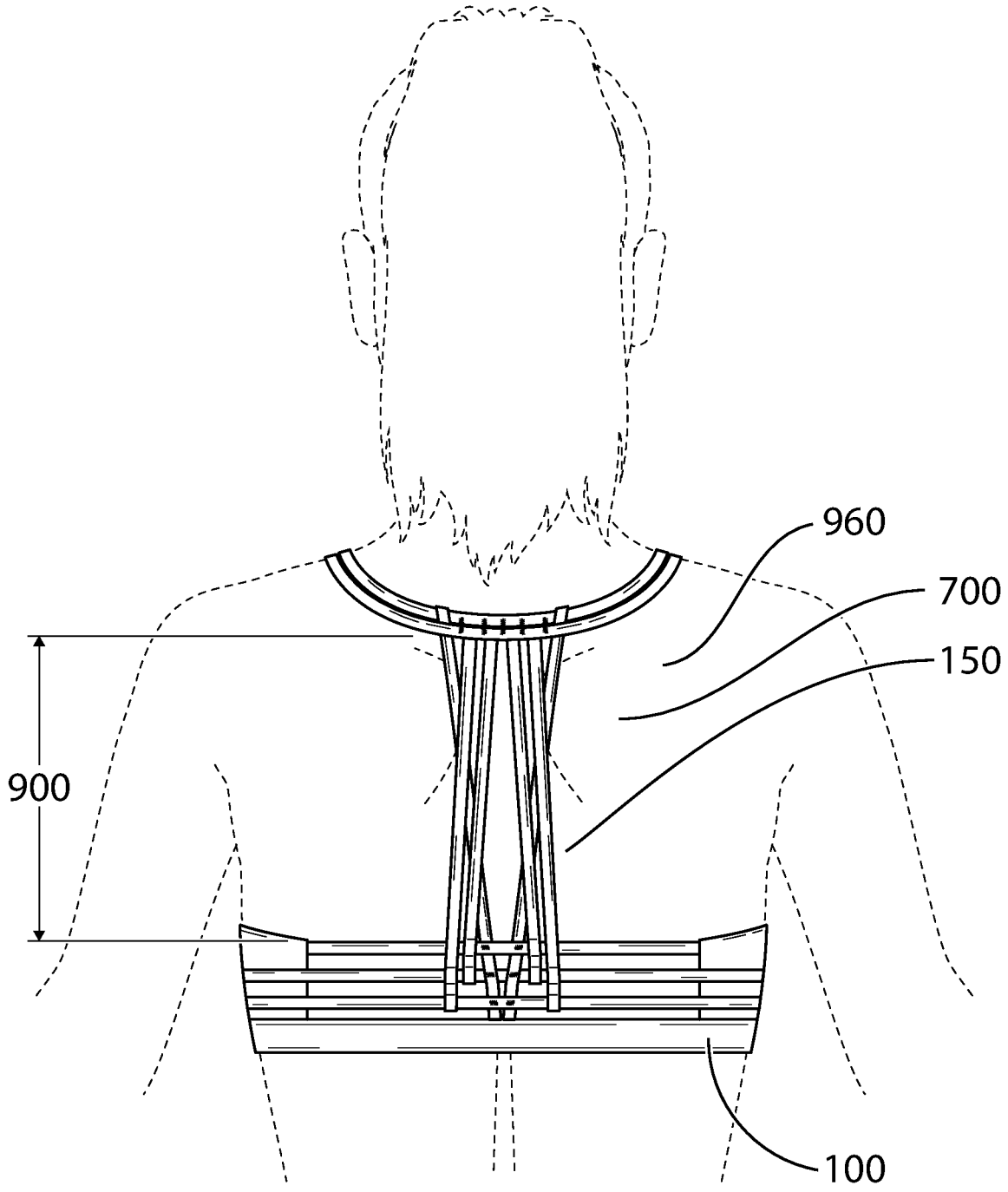
FIG. 10 is a rear view illustrating the garment of FIG. 1 with the adjustable straps thereof shown in a retracted (or narrowest) position in accordance with an embodiment of the application.
Figure 11:
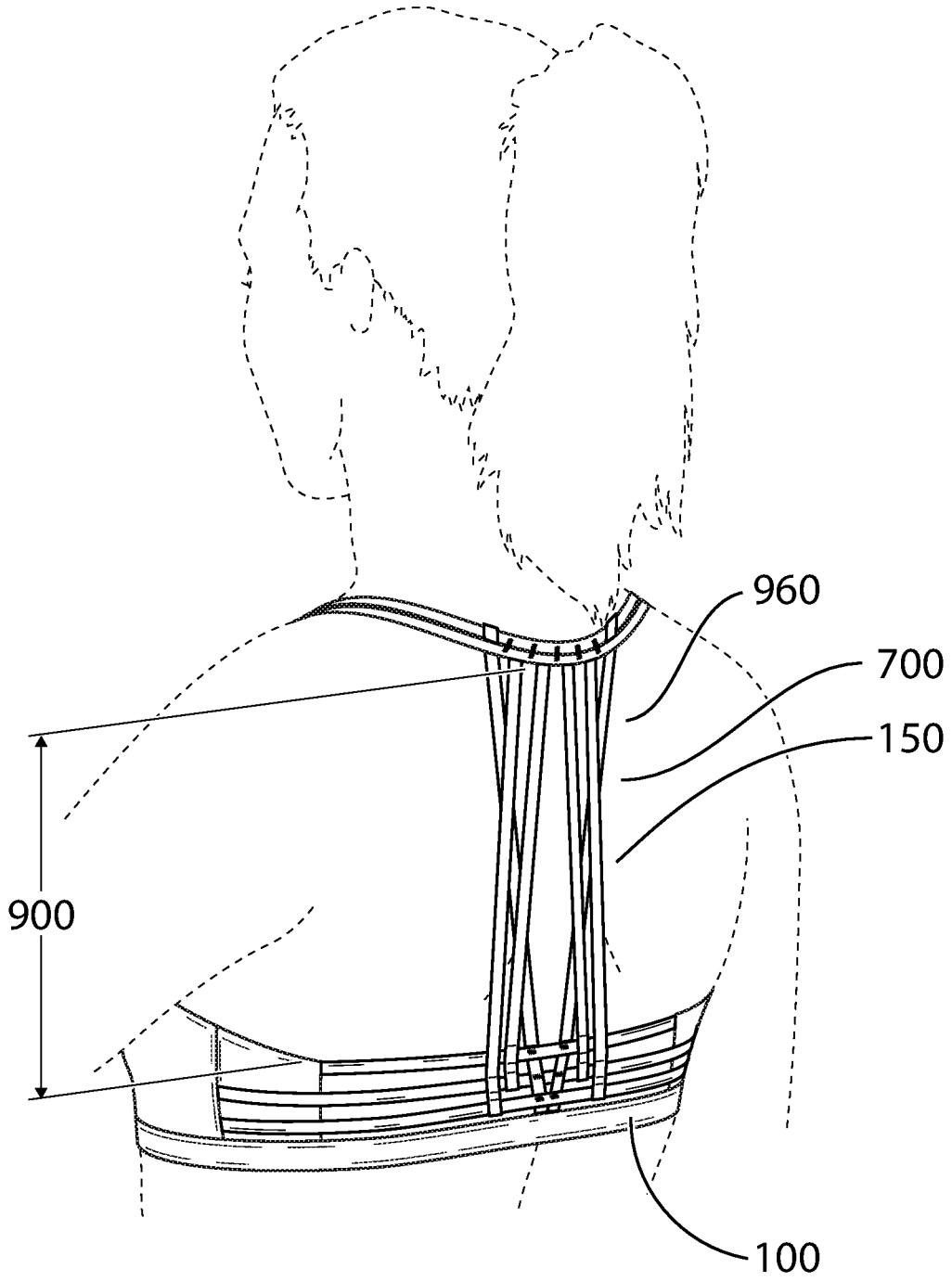
FIG. 11 is a rear perspective environmental view thereof illustrating the positioning of the garment on a wearer's body and showing the adjustable straps in a retracted position.
Figure 12:
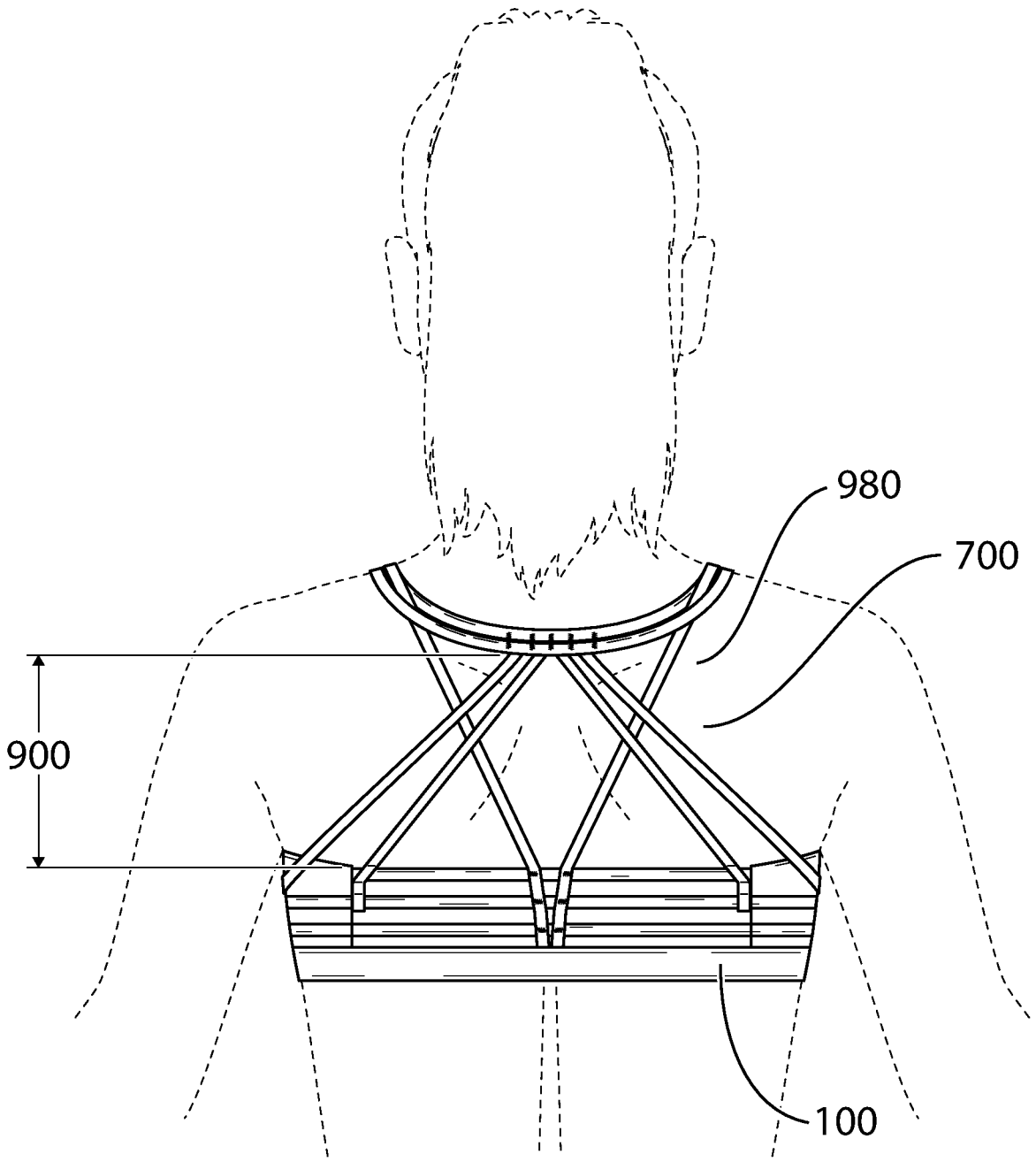
FIG. 12 is rear view illustrating the garment of FIG. 1 with the adjustable straps thereof shown in a fully extended (or widest) position in accordance with an embodiment of the application.
Figure 13:
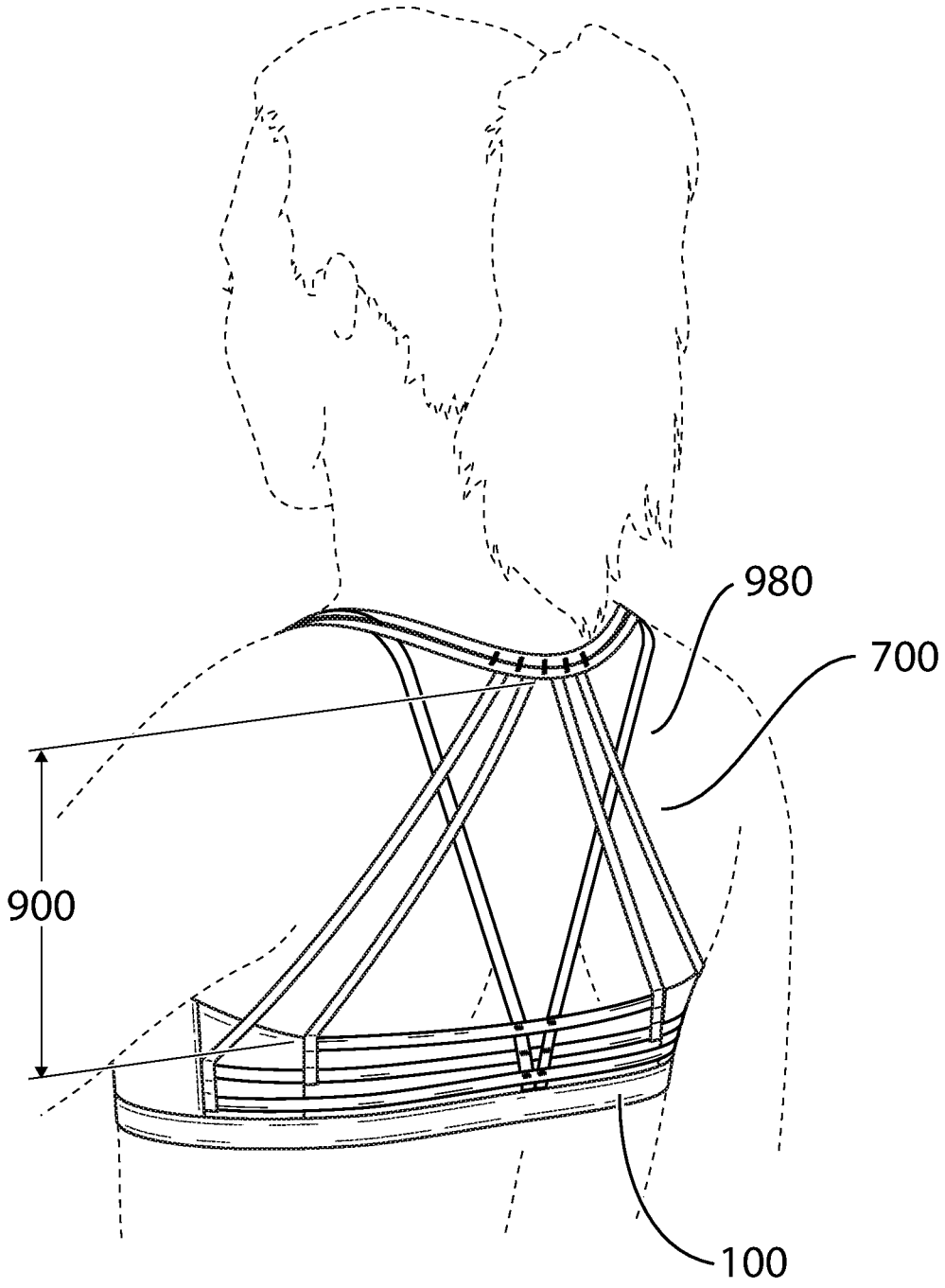
FIG. 13 is a rear perspective environmental view thereof illustrating the positioning of the garment on a wearer's body and showing the adjustable straps in a fully extended position.

FIG. 1 is a front view illustrating a garment 100 in accordance with an embodiment of the application. FIG. 2C is rear view thereof with the adjustable straps 700 thereof shown in a partially extended (or middle) position 970 in accordance with an embodiment of the application. FIG. 3 is a right side view thereof. FIG. 4 is a left side view thereof. FIG. 5 is a front perspective view thereof. FIG. 6 is a rear perspective view thereof. FIG. 7 is a front environmental view thereof illustrating the positioning of the garment 100 on a wearer's body 1000. FIG. 8 is a rear environmental view thereof illustrating the positioning of the garment 100 on a wearer's body 1000. FIG. 10 is rear view illustrating the garment 100 of FIG. 1 with the adjustable straps 700 thereof shown in a retracted (or narrowest) position 960 in accordance with an embodiment of the application. FIG. 11 is a rear environmental view thereof illustrating the positioning of the garment 100 on a wearer's body 1000. FIG. 12 is rear view illustrating the garment 100 of FIG. 1 with the adjustable straps 700 thereof shown in a fully extended (or widest) position 980 in accordance with an embodiment of the invention. And, FIG. 13 is a rear environmental view thereof illustrating the positioning of the garment 100 on a wearer's body 1000.

According to one embodiment of the invention, a garment 100 such as a bra, sports bra, tank top, or dress is provided. The garment 100 has a front 110, a back 120, a right side 130, and a left side 140 and includes: a body portion or body 200; and, straps 150 (see FIG. 2A) for securing the body 200 around the neck 1010 (see FIG. 7) and across the back 1045 (see FIG. 8) of the wearer (i.e., the wearer's body) 1000. The straps 150 include: at least one neck strap 500, 550 (FIG. 2B) attached to the body 200; at least one back strap 660, 630, 600 attached to the body 200; and, adjustable straps 700 (FIG. 2C) extending between and slidably attached to the at least one neck strap 500, 550 and to the at least one back strap 660, 630, 600.

The body 200 of the garment 100 covers at least a portion of the chest 1050 (i.e., the breasts) and right and left sides 1042, 1043 (FIG. 7), of the wearer 1000 and may be sized to fit the wearer 1000. The body 200 includes: a front body panel (or fabric panel) 210; and, first and second or right and left wing panels (or fabric panels) 240, 250 that form a back body panel and/or side panels (or fabric panels) of the garment 100.

The neck opening or hole 270 is defined or formed by the upper edge 201 of the body 200 and the upper edge 501 of the neck strap 500. According to one embodiment, the garment 100 has two neck straps such as a first (upper) neck strap 500 and a second (lower) neck strap 550, however, persons skilled in the art would understand that the garment 100 may have one neck strap (e.g., neck strap 500 only) or more than two neck straps without departing from the scope of the application. The first and second or right and left arm openings 280, 290 are defined or formed by respective side edges 203, 204 of the body 200 and respective side edges 701, 702 of the adjustable straps 700. And, the torso opening or hole 295 is defined or formed by the bottom edge 302 of the body 200. The neck opening 270, arm openings 280, 290, and torso opening 295 are for receiving the neck 1010, arms 1020, 1030, and torso 1040 of the wearer 1000, respectively.

According to one embodiment, the front body panel 210 and the back body panel (i.e., the wings 240, 250) may be made from or include a material or fabric such as lycra (e.g., Power Extreme Black Lycra™, etc.) or any other suitable material or fabric.

In one embodiment, the body 200 may include an underbust band 300 that secures the garment 100 around the torso 1040 (i.e., the bustline 1041, right and left sides 1042, 1043, and back 1045) of the wearer 1000 and may be sized to fit the wearer 1000. According to one embodiment, the underbust band 300 is attached along an upper edge 301 thereof to the lower edge 202 of the body 200 while the bottom edge 302 of the underbust band 300 forms the bottom edge 302 of the body 200. The underbust band 300 has a midpoint (or approximate midpoint) 320 on the back 120 of the garment 100 as will be discussed further below. According to one embodiment, the underbust band 300 may be formed from a strip of knit elastic material (e.g., 25 mm wide) which may be encased in a material or fabric made from or including lycra (e.g., Power Extreme Black Lycra™ etc.). The ends of the strip may be joined to form the band 300 and the joint may be positioned on one side (e.g., the left side 206) of the body 200 below the front edge 251 of the second or left side wing 250.

The first and second or upper and lower neck straps 500, 550 secure the garment 100 around the neck 1010 of the wearer 1000 and may be sized to fit the wearer 1000. The first or upper neck strap 500 is positioned above the second or lower neck strap 550 around the neck 1010 of the wearer 1000. According to one embodiment, the neck straps 500, 550 are positioned horizontally or approximately horizontally around the neck 1010 of the wearer 1000 (i.e., across the back 120 of the garment 100). The first and second neck straps 500, 550 are attached at respective first or left ends 505, 555 to the first or right side 207 of the upper edge 201 of the body 200 (or front panel 210) and at respective second or right ends 510, 560 to the second or left side 208 of the upper edge 201 of the body 200 (or front panel 210). The first and second neck straps 500, 550 have respective midpoints (or approximate midpoint) 530, 580 (FIG. 2C) on the back 120 of the garment 100 as will be discussed further below.

According to one embodiment, the neck straps 500, 550 may be positioned adjacent to each other along their respective lengths. According to one embodiment, the neck straps 500, 550 may be attached together proximate their respective midpoints 530, 580 using a strip of material or fabric 1400 (FIG. 16) attached across the inner surfaces of the neck straps 500, 550 as further described below. According to another embodiment, the neck straps 500, 550 may be spaced from each other along their respective lengths. According to yet another embodiment, the neck straps 500, 550 may be attached together proximate their respective first or left ends 505, 555 and/or at their respective second or right ends 510, 560 and/or at any other point along their respective lengths.

According to one embodiment, the neck straps 500, 550 may be formed from respective strips of synthetic rubber tape (e.g., 0.5 mm wide) or any other flexible material, and it may be encased in a material or fabric made from or including lycra (e.g., Power Extreme Black Lycra™, etc.).

One or more back straps secure the garment 100 across the back 1045 of the wearer 1000 and may be sized to fit the wearer 1000. In the embodiment illustrated in FIGS. 2A-2C, the garment 100 includes three back straps, such as first, second, and third or lower, middle, and upper back straps 660, 630, 600, however, persons skilled in the art would understand that the garment 100 may include more or less than three back straps without departing from the scope of the application. The third or upper back strap 600 is positioned above the second or middle back strap 630 which is in turn positioned above the first or lower back strap 660 across the back 1045 of the wearer 1000 (i.e., across the back 120 of the garment 100). In one embodiment, the back straps 660, 630, 600 may be positioned above the underbust band 300 across the back 1045 of the wearer 1000 (i.e., across the back 120 of the garment 100). The first, second, and third back straps 660, 630, 600 have respective midpoints (or approximate midpoint) 675, 645, 615 on the back 120 of the garment 100 as will be discussed further below. According to one embodiment, the back straps 660, 630, 600 are positioned horizontally or approximately horizontally across the back 120 of the garment 100.

The first or lower back strap 660 is attached at the first or right end 665 to the lower end 254 of the front edge 251 of the second or left wing panel 250 on the left side 206 of the body 200 of the garment 100 and at the second or left end 670 to the lower end 244 of the front edge 241 of the first or right wing panel 240 on the right side 205 of the body 200 of the garment 100.

The second or middle back strap 630 is attached at the first or right end 635 to the midpoint (or approximate midpoint) 255 of the front edge 251 of the second or left wing panel 250 on the left side 206 of the body 200 of the garment 100 and at the second or left end 640 to the midpoint (or approximate midpoint) 245 of the front edge 241 of the first or right wing panel 240 on the right side 205 of the body 200 of the garment 100.

As such, according to one embodiment, the first or lower back strap 660 and the second or middle back strap 630 extend over the right and left wing panels 240, 250 of the body 200 of the garment 100.

The third or upper back strap 600 is attached at the first or right end 605 to the upper end 253 of the rear edge 252 of the second or left wing panel 250 and at the second or left end 610 to the upper end 243 of the rear edge 242 of the first or right wing panel 240 on the back 120 of the garment 100. Persons skilled in the art would understand that the upper back strap 600 may also extend over the right and left wing panels 240, 250 of the body 200 or the lower and/or middle back straps 660, 630 may be connected to the respective rear edges 252, 242 of the wing panels 250, 240 without departing from the scope of the application.

In one embodiment, the wing panels 240, 250 may be omitted and the back straps 600, 630, 660 may be connected to respective lower side edges of the body 200 such that the one or more back straps 600, 630, 660 form at least a portion of the back body panel and/or side panels of the garment 100.

According to one embodiment, the back straps 660, 630, 600 may be positioned adjacent to each other along their respective lengths. According to another embodiment, the back straps 660, 630, 600 may be spaced from each other along their respective lengths. According to yet another embodiment, the back straps 660, 630, 600 may be attached together proximate their respective midpoints 675, 645, 615 and/or proximate their respective right and/or left ends.

According to one embodiment, the back straps 660, 630, 600 may be formed from strips of synthetic rubber tape (e.g., 0.5 mm wide) or any other suitable material, and may be encased in a material or fabric made from or including lycra (e.g., Power Extreme Black Lycra™, etc.).

Figure 15:
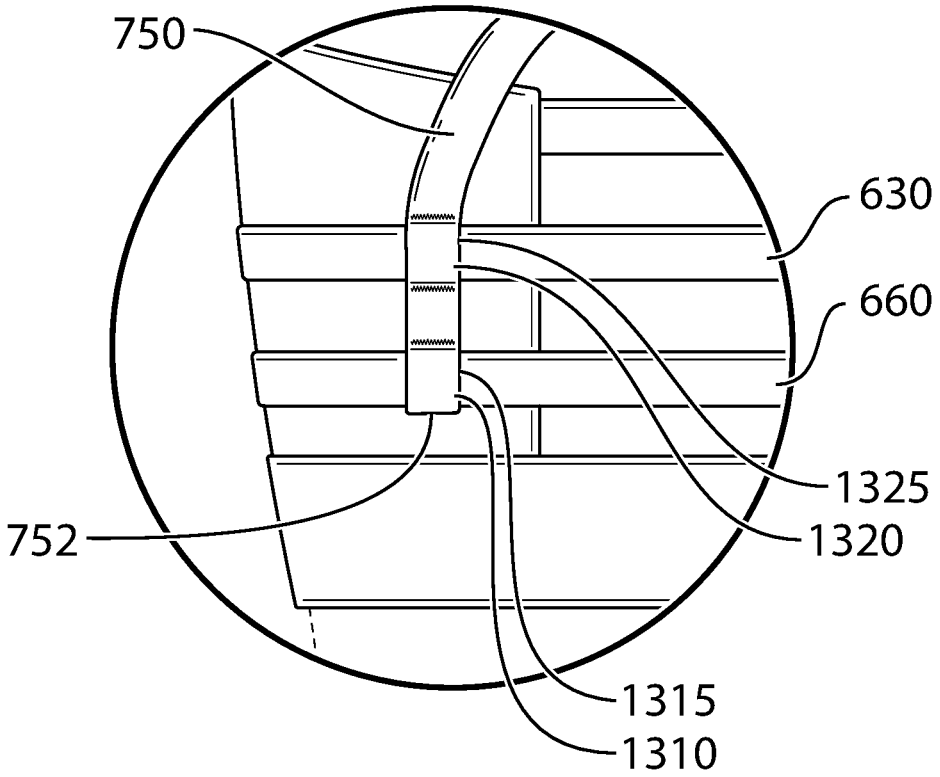
FIG. 15 is a detail view illustrating the attachment of one of the adjustable straps to back straps of the garment of FIG. 1 in accordance with an embodiment of the application; and, FIG. 16 is a detail view illustrating the attachment of pairs of adjustable straps to the neck straps in accordance with an embodiment of the application.
Figure 16:
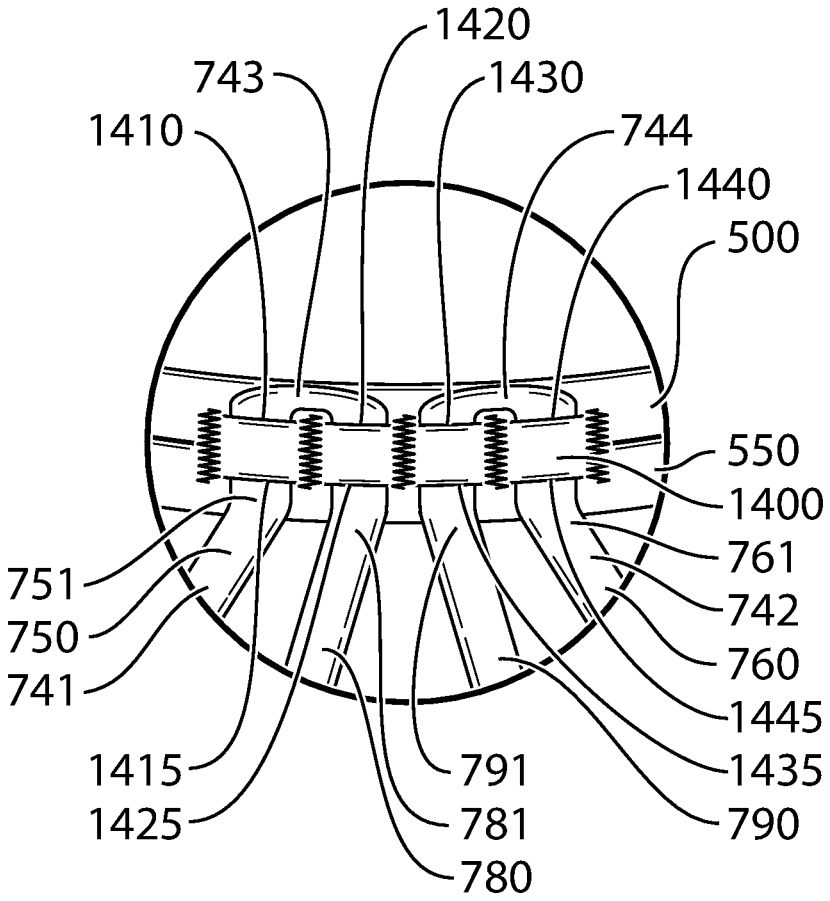

FIG. 15 is a rear detail view illustrating the attachment of one (e.g., 720) of the first pair of adjustable straps 710 to the first or upper neck strap 500 of the garment 100 of FIG. 1 in accordance with an embodiment of the application. FIG. 15 is a detail view illustrating the attachment of one (e.g., 750) of the second pair of adjustable straps 740 to the first and second or lower and middle back straps 660, 630 of the garment 100 of FIG. 1 in accordance with an embodiment of the application. And, FIG. 16 is a detail view illustrating the attachment of the second and third pairs of adjustable straps 740, 770 to the first and second or upper and lower neck straps 500, 550 in accordance with an embodiment of the application.

The garment 100 may include at least one pair of adjustable straps 700 (FIG. 2C). The adjustable straps 700 on the back 120 of the garment 100 may be slidably attached to at least one of the neck straps 500, 550 and at least one of the back straps 660, 630, 600 (or optionally to the underbust band 300) and may be sized to fit the wearer 1000. According to one embodiment, the adjustable straps 700 include: a first pair 710 of first and second or right and left adjustable straps 720, 730; a second pair 740 of first and second or right and left adjustable straps 750, 760; and, a third pair 770 of first and second or right and left adjustable straps 780, 790. According to one embodiment, as further describe below, one or more of the adjustable straps (e.g., 740) may be continuous straps (e.g., 741) having first and second portions or arms (e.g., 750, 760) or either side of an approximate midpoint or vertex (e.g., 743) and may be V-shaped or approximately V-shaped (or inverted V-shaped or approximately inverted V-shaped) when in the partially extended (or middle) and fully extended (or widest) positions 970, 980. In one embodiment, the one or more pairs of adjustable straps 710, 740, 770 may be formed of one continuous strap that extends between the neck straps 500, 550 and back straps 660, 630, 600 forming one or more V-shaped (or approximately V-shaped) and/or inverted V-shaped (or approximately inverted V-shaped) adjustable straps pairs.

In one embodiment, the first pair 710 of the first and second adjustable straps 720, 730 may be fixedly attached at respective lower ends 722, 732 to the underbust band 300 on either side of the midpoint (or approximate midpoint) 320 of the underbust band 300 on the back 120 of the garment 100 and slidably attached at respective upper ends 721, 731 to respective first and second or right and left portions 515, 525 of the first neck strap 500 on either side of the midpoint (or approximate midpoint) 530 of the first neck strap 500 on the back 120 of the garment 100. The upper ends 721, 722 of the first pair of adjustable straps 710 are movable (e.g., slidable) along the length of the neck strap, for example along each portion 515, 525 of the first neck strap 500 between respective first positions 516, 526 (FIG. 2B) proximate the midpoint 530 of the first neck strap 500 and second positions 517, 527 proximate the body 200 or the respective ends 505, 510 of the first neck strap 500 (and positions therebetween) to adjust the fit of the garment 100 across the back 1045 (i.e., the upper back 1046) of the wearer 1000.

Figure 14:
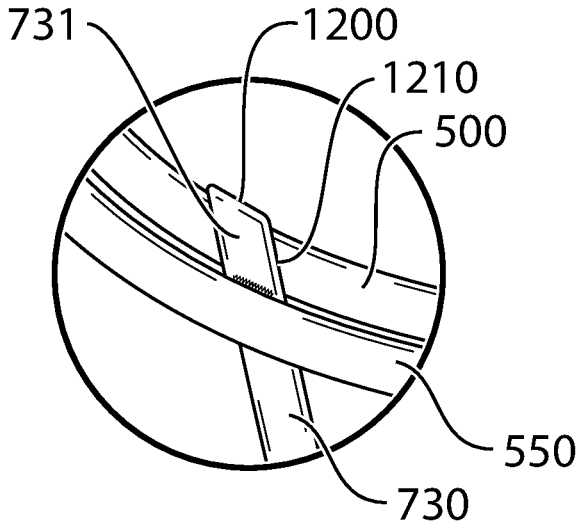
FIG. 14 is a rear detail view illustrating the attachment of one of the adjustable straps to a neck strap of the garment of FIG. 1 in accordance with an embodiment of the application.

According to one embodiment, the upper ends 721, 731 of the first pair of adjustable straps 710 are slidably attached to the first neck strap 500 by way of respective loops or eyelets 1200 (FIG. 14) formed on the upper ends 721, 731 of the first pair 710 of adjustable straps 720, 730. The first neck strap 500 passes through the hole or opening 1210 of each eyelet 1200 of each adjustable strap 720, 730 allowing the adjustable straps 720, 730 to move or slide along the length of the first neck strap 500. The fit between the inner side of the opening 1210 of each eyelet 1200 and the first neck strap 500 is snug in order to keep the upper ends 721, 731 of the adjustable straps 720, 730 in position along the first neck strap 500. According to one embodiment, each eyelet 1200 may be formed by folding an end portion of each adjustable strap (e.g., 720) back over on the adjustable strap 720 and stitching (or otherwise attaching) the end portion in place leaving an opening 1210 between the end portion and the adjustable strap 720.

According to one embodiment, the respective lower ends 722, 732 of the first and second adjustable straps 720, 730 can be attached (fixedly or slidably) to the first, second, and/or third back straps 660, 630, 600 on either side of the respective midpoints (or approximate midpoints) 675, 645, 615 of the first, second, and third back straps 660, 630, 600 on the back 120 of the garment 100. Advantageously, these additional attachments maintain the spacings between the back straps 660, 630, 600 (and optionally between the back straps and the underbust band 300).

According to one embodiment, the lower ends 722, 732 of the first and second adjustable straps 720, 730 are attached to the inner sides of the first and third back straps 660, 600 and to the outer side of the second back strap 630. That is, the lower ends 722, 732 of the first and second adjustable straps 720, 730 are woven between the first, second, and third back straps 660, 630, 300.

In one embodiment, the second pair 740 of first and second adjustable straps 750, 760 are fixedly (or slidably) attached at respective upper ends 751, 761 (FIG. 16) to the first and second neck straps 500, 550 on either side of the respective midpoints (or approximate midpoints) 530, 580 of the first and second neck straps 500, 550 on the back 120 of the garment 100 and slidably attached at respective lower ends 752, 762 to respective first and second or right and left portions 680, 685 of the first or lower back strap 660 on either side of the midpoint (or approximate midpoint) 675 of the first back strap 660 on the back 120 of the garment 100 and to respective first and second or right and left portions 650, 655 of the second or middle back strap 630 on either side of the midpoint (or approximate midpoint) 645 of the second back strap 630 on the back 120 of the garment 100. The lower ends 752, 762 of the second pair 740 of adjustable straps 750, 760 are movable (e.g., slidable) along the length of the first back strap 660, for example, along each portion 680, 685 (FIG. 2B) of the first back strap 660 between respective first positions 681, 686 proximate the midpoint 675 of the first back strap 660 and second positions 682, 687 proximate the body 200 or the respective ends 665, 670 of the first back strap 660 (and positions therebetween) and simultaneously along each portion 650, 655 of the second back strap 630 between respective first positions 651, 656 proximate the midpoint 645 of the second back strap 630 and second positions 652, 657 proximate the body 200 or the respective ends 635, 640 of the second back strap 630 (and positions therebetween) to further adjust the fit of the garment 100 across the back 1045 (i.e., the lower back 1047) of the wearer 1000.

Advantageously, the attachment of the lower ends 752, 762 of the second pair 740 of adjustable straps 750, 760 to both the first and second back straps 660, 630 maintains the spacing between these back straps 660, 630.

According to one embodiment, the lower ends 752, 762 of the second pair 740 of adjustable straps 750, 760 are slidably attached to the first and second back straps 660, 630 by way of respective lower and upper loops or eyelets 1320, 1310 (FIG. 15) formed on the lower ends 752, 762 of the second pair 740 of adjustable straps 750, 760. The first and second back straps 660, 630 pass through respective holes or openings 1325, 1315 of each eyelet 1320, 1310 of each adjustable strap 750, 760 allowing the adjustable straps 750, 760 to move or slide along the first and second back straps 660, 630. The fit between the inner sides of the openings 1325, 1315 of each eyelet 1320, 1310 and the first and second back straps 660, 630 is snug in order to keep the lower ends 752, 762 of the adjustable straps 750, 760 in position along the first and second back straps 660, 630.

According to one embodiment, the eyelets 1320, 1310 may be formed by folding an end portion of each adjustable strap (e.g., 750) back over on the adjustable strap 750 and stitching (or otherwise attaching) the end portion in two (or three) locations leaving spaced openings 1325, 1315 between the end portion and the adjustable strap 750.

Advantageously, the attachment of the lower ends 752, 762 of the second pair 740 of adjustable straps 750, 760 to both the first and second back straps 660, 630 by way of the lower and upper eyelets 1320, 1310 further maintains the spacing between these back straps 660, 630.

In one embodiment, the third pair 770 of first and second adjustable straps 780, 790 are fixedly (or slidably) attached at respective upper ends 781, 791 (FIG. 16) to the first and second neck straps 500, 550 on either side of the respective midpoints (or approximate midpoints) 530, 580 of the first and second neck straps 500, 550 on the back 120 of the garment 100 and slidably attached at respective lower ends 782, 792 to respective first and second or right and left portions 623, 633 of the third or upper back strap 600 on either side of the midpoint (or approximate midpoint) 615 of the third back strap 600 on the back 120 of the garment 100 and to respective first and second or right and left portions 650, 655 of the second or middle back strap 630 on either side of the midpoint (or approximate midpoint) 645 of the second back strap 630 on the back 120 of the garment 100. The lower ends 782, 792 of the third pair 770 of adjustable straps 780, 790 are movable (e.g., slidable) along the length of the third back strap 600, for example, along each portion 623, 633 of the third back strap 600 between respective first positions 621, 631 proximate the midpoint 615 of the third back strap 600 and second positions 622, 632 proximate the body 200 or the respective ends 605, 610 of the third back strap 600 (and positions therebetween) and simultaneously along each portion 650, 655 of the second back strap 630 between respective first positions 651, 656 proximate the midpoint 645 of the second back strap 630 and second positions 652, 657 proximate the body 200 or the respective ends 635, 640 of the second back strap 630 (and positions therebetween) to further adjust the fit of the garment 100 across the back 1045 (i.e., the lower back 1047) of the wearer 1000.

Advantageously, the attachment of the lower ends 782, 792 of the third pair 770 of adjustable straps 780, 790 to both the second and third back straps 630, 600 maintains the spacing between these back straps 630, 600.

According to one embodiment, the lower ends 782, 792 of the third pair 770 of adjustable straps 780, 790 are slidably attached to the second and third back straps 630, 600 by way of respective lower and upper loops or eyelets 1320, 1310 formed on the lower ends 782, 792 of the third pair 770 of adjustable straps 780, 790. The second and third back straps 630, 600 pass through respective holes or openings 1325, 1315 of each eyelet 1320, 1310 of each adjustable strap 780, 790 allowing the adjustable straps 780, 790 to move or slide along the second and third back straps 630, 600. The fit between the inner sides of the openings 1325, 1315 of each eyelet 1320, 1310 and the second and third back straps 630, 600 is snug in order to keep the lower ends 782, 792 of the adjustable straps 780, 790 in position along the second and third back straps 630, 600.

According to one embodiment, the eyelets 1320, 1310 may be formed by folding an end portion of each adjustable strap (e.g., 780) back over on the adjustable strap 780 and stitching (or otherwise attaching) the end portion in two (or three) locations leaving spaced openings 1325, 1315 between the end portion and the adjustable strap 780.

Advantageously, the attachment of the lower ends 782, 792 of the third pair 770 of adjustable straps 780, 790 to both the second and third back straps 630, 600 by way of the lower and upper eyelets 1320, 1310 further maintains the spacing between these back straps 630, 600.

According to one embodiment, the respective upper ends 781, 791 of the third pair 770 of first and second adjustable straps 780, 790 are attached to the first and second neck straps 500, 550 between the respective upper ends 751, 761 of the second pair 740 of first and second adjustable straps 750, 760.

According to one embodiment, the adjustable straps 700 may be formed from strips of synthetic rubber tape (e.g., 0.5 mm wide) or any other suitable material, and may be encased in a material or fabric made from or including lycra (e.g., Power Extreme Black Lycra™, etc.).

In one embodiment, as the first pair 710 of adjustable straps 720, 730 are moved or slid along the first neck strap 500 from the midpoint 530 thereof toward the body 200 of the garment 100, that is, from their first positions 516, 526 toward their second positions 517, 527, they exert an increasing tensile force or pull on the first and second sides 207, 208 of the upper edge 201 of the body 200 (i.e., the upper corners 207, 208 of the body 200) downward and inward toward the midpoint 320 of the underbust band 300 (and/or the midpoints 675, 645, 615 of the first, second, and third back straps 660, 630, 600). This tightens the fit of the garment 100 across the upper back 1046 of the wearer 1000.

As the second pair 740 of adjustable straps 750, 760 are moved or slid along the first and second back straps 660, 630 from the midpoints 675, 645 thereof toward the body 200 of the garment 100, that is, from their respective first positions 681, 686, 651, 656 toward their respective second positions 682, 687, 652, 657, they exert an increasing tensile force or pull on the respective front edges 251, 241 of the respective wings 250, 240 of the body 200 upward and inward toward the midpoints 530, 580 of the first and second neck straps 500, 550. This tightens the fit of the garment 100 across the lower back 1047 of the wearer 1000.

Similarly, as the third pair 770 of adjustable straps 780, 790 are moved or slid along the second and third back straps 630, 600 from the midpoints 645, 615 thereof toward the body 200 of the garment 100, that is, from their respective first positions 651, 656, 621, 631 toward their respective second positions 652, 657, 622, 632, they exert an increasing tensile force or pull on the respective rear edges 252, 242 of the respective wings 250, 240 of the body 200 upward and inward toward the midpoints 530, 580 of the first and second neck straps 500, 550. This further tightens the fit of the garment 100 across the lower back 1047 of the wearer 1000.

In addition, and referring again to FIGS. 2, 8, and 10, as the adjustable straps 700 are moved toward the body 200 of the garment 100 from their retracted (or narrowest) position 960 through their partially extended (or middle) position 970 to their fully extended (or widest) position 980, tension in the adjustable straps 700 is increased and they pull the neck straps 500, 550 toward the back straps 600, 630, 660 and underbust band 300 thereby decreasing the distance or spacing 900 between the neck straps 500, 550 and the back straps 660, 630, 600 and underbust band 300. This tightens the fit and increases the support of the garment 100.

Similarly, as the adjustable straps 700 are moved away from the body 200 of the garment 100 from their fully extended (or widest) position 980 through their partially extended (or middle) position 970 to their retracted (or narrowest) position 960, tension in the adjustable straps 700 is decreased (i.e., slack in the adjustable straps 700 is increased) allowing the neck straps 500, 550 and the back straps 600, 630, 660 and underbust band 300 to be pulled farther apart by the wearer thereby increasing the spacing 900 between the neck straps 500, 550 and the back straps 600, 630, 660 and underbust band 300. This loosens the fit and decreases the support of the garment 100.

Advantageously, the adjustable straps 700 allow the garment 100 to be adjusted for wearers having differently sized torsos 1040. For wearers having shorter torsos 1040 and hence requiring a smaller spacing 900 between the neck straps 500, 550 and the back straps 600, 630, 660 and underbust band 300, the adjustable straps 770 may be moved toward the body 200 of the garment 100 from their retracted (or narrowest) position 960 through their partially extended (or middle) position 970 to their fully extended (or widest) position 980 to thereby reduce the spacing 900. Similarly, for wearers having longer torsos 1040 and hence requiring a larger spacing 900 between the neck straps 500, 550 and the back straps 600, 630, 660 and underbust band 300, the adjustable straps 770 may be moved away from the body 200 of the garment 100 from their fully extended (or widest) position 980 through their partially extended (or middle) position 970 to their retracted (or narrowest) position 960 to thereby increase the spacing 900.

According to one embodiment, the respective first adjustable straps 750, 780 of the second and third pairs 740, 770 of adjustable straps 700 are one continuous strap from respective lower end 752 to lower end 782. In other words, these straps 750, 780 are not separated at their upper ends 751, 781. In this embodiment, the first adjustable straps 750, 780 of the second and thirds pairs 740, 770 of adjustable straps 700 represent first and second portions 750, 780 of a first or right continuous adjustable strap 741. Similarly, the respective second adjustable straps 760, 790 of the second and third pairs 740, 770 of adjustable straps 700 are one continuous strap from respective lower end 762 to lower end 792. In other words, these straps 760, 790 are not separated at their upper ends 761, 791. In this embodiment, the second adjustable straps 760, 790 of the second and third pairs 740, 770 of adjustable straps 700 represent first and second portions 760, 790 of a second or left continuous adjustable strap 742. The first and second continuous adjustable straps 741, 742 are attached at their respective vertices or midpoints (or approximate midpoints) 743, 744 (FIG. 16) to the first and/or second neck straps 500, 550, on either side of their respective midpoints 530, 580, using a strip of material or fabric 1400. As mentioned above, the strip of fabric 1400 also serves to attach the inner surfaces of the first and second neck straps 500, 550 together. The first and second continuous adjustable straps 741, 742 pass through respective first and second pairs of channels or eyelets 1410, 1420, 1430, 1440 formed by the strip of fabric 1400 and the inner surfaces of the first and second neck straps 500, 550. The eyelets 1410, 1420, 1430, 1440 may be formed by stitching (or otherwise attaching) the strip of fabric 1400 to the first and second neck straps 500, 550 at five locations forming four spaced openings 1415, 1425, 1435, 1445. The continuous adjustable straps 741, 742 are movable or slidable through their respective eyelets 1410, 1420, 1430, 1440 allowing the respective lengths of the respective first and second portions 750, 780, 760, 790 of each continuous adjustable strap 741, 742 to be adjusted by the wearer to reduce slack, etc. The fit between the inner sides of the openings 1415, 1425, 1435, 1445 of each eyelet 1410, 1420, 1430, 1440 and the continuous adjustable straps 741, 742 is snug in order to keep the continuous adjustable straps 780, 790 in position once adjusted. Advantageously, the use of continuous adjustable straps 741, 742 allows the wearer to fine-tune the fit of the garment 100.

In operation, a wearer puts on the garment 100 by inserting her head 1060 through the torso and neck openings 295, 270 and her arms 1020, 1030 through the arm openings 280, 290. The wearer may then adjust the first pair 710 of adjustable straps 720, 730 by moving their respective upper ends 721, 731 toward or away from the body 200 of the garment 100 to adjust the fit of the garment 100 across the wearer's upper back 1046. The closer the wearer moves the respective upper ends 721, 731 of the first pair 710 of adjustable straps 720, 730 toward the body 200 of the garment 100, the tighter the fit and the more support that the garment 100 will provide. The farther the wearer moves the respective upper ends 721, 731 of the first pair 710 of adjustable straps 720, 730 away from the body 200 of the garment 100, the looser the fit and the less support that the garment 100 will provide. In addition, the wearer may adjust the second and third pairs 740, 770 of adjustable straps 750, 760, 780, 790 by moving their respective lower ends 752, 762, 782, 792 toward or away from the body 200 of the garment 100 to adjust the fit of the garment 100 across the wearer's lower back 1047. The closer the wearer moves the respective lower ends 752, 762, 782, 792 of the second and third pairs 740, 770 of adjustable straps 750, 760, 780, 790 toward the body 200 of the garment 100, the tighter the fit and the more support that the garment 100 will provide. The farther the wearer moves the respective lower ends 752, 762, 782, 792 of the second and third pairs 740, 770 of adjustable straps 750, 760, 780, 790 away from the body 200 of the garment 100, the looser the fit and the less support that the garment 100 will provide. Furthermore, the wearer may fine-tune the fit of the garment 100 by adjusting the relative lengths of the second and third pairs 740, 770 of adjustable straps 750, 760, 780, 790 to reduce slack, etc. The above adjustments may be made by the wearer while the wearer is wearing the garment 100 or prior to the wearer putting the garment 100 on.

The above embodiments may contribute to improved adjustable straps 700 for a garment 100 and may provide one or more advantages. First, a garment 100 including the adjustable straps 700 does not require buckles for strap adjustment. Second, the adjustable straps 700 may be adjusted to be hidden or visible under an over garment. Third, the fit of a garment 100 including the adjustable straps 700 may to adjusted to fit wearers having torsos of different lengths.

The embodiments of the application described above are intended to be examples only. Those skilled in the art will understand that various modifications of detail may be made to these embodiments, all of which come within the scope of the application.

What is claimed is:

1. Straps for a garment, the garment having a body for covering at least a portion of a chest of a wearer, the straps comprising:

at least one neck strap;

at least one back strap; and, at least one pair of adjustable straps, each arm of the pair of adjustable straps having a lower end that is attached to the at least one back strap on either side of a midpoint thereof and an upper end attached to the at least one neck strap, wherein the at least one pair of adjustable straps further comprise sliding means formed at the upper end such that the adjustable straps are slidable on either side of a midpoint of the neck strap, and wherein the second ends of the at least one pair of the adjustable straps are slidable along the neck strap between respective first positions proximate the midpoint of the neck strap and second positions distal the midpoint of the neck strap to adjust a fit of the garment across an upper back of the wearer and to adjust a spacing between the neck strap and the back strap.

2. The straps of claim 1, further comprising: at least one additional pair of adjustable straps attached at respective upper ends to the neck strap on either side of the midpoint thereof and attached at respective lower ends to the back strap on either side of a midpoint thereof.

3. Straps for a garment, the garment having a body for covering a portion of a chest of a wearer, the straps comprising:

a neck strap;

a back strap; and, at least one pair of adjustable straps attached at respective lower ends to the back strap on either side of a midpoint thereof and slidably attached at respective upper ends to the neck strap on either side of a midpoint thereof, wherein the upper ends of the first pair of adjustable straps are slidable along the neck strap between respective first positions proximate the midpoint of the neck strap and second positions distal the midpoint of the neck strap to adjust a fit of the garment across an upper back of the wearer and to adjust a spacing between the neck strap and the back strap.

4. The straps of claim 3, further comprising:

an additional pair of adjustable straps attached at respective upper ends to the neck strap on either side of the midpoint thereof and slidably attached at respective lower ends to the back strap on either side of a midpoint thereof, wherein the lower ends of the additional pair of adjustable straps are slidable along the back strap between respective first positions proximate the midpoint of the back strap and second positions distal the midpoint of the back strap to further adjust a fit of the garment across a lower back of the wearer and to further adjust the spacing between the neck strap and the back strap.

5. A garment, comprising:

a body for covering a portion of a chest of a wearer; and, straps according to any one of claims 1 to 4 for securing the body around a neck and across a back of the wearer.

6. Adjustable straps for a garment, the garment having a body for covering a portion of a chest of a wearer, a neck strap extending between first and second sides of an upper edge of the body for securing the body around a neck of the wearer, and a back strap extending between first and second lower side edges of the body for securing the body around a lower back of the wearer, the adjustable straps comprising:

a first pair of adjustable straps attached at respective lower ends to the back strap on either side of a midpoint thereof and slidably attached at respective upper ends to the neck strap on either side of a midpoint thereof, wherein the upper ends of the first pair of adjustable straps are slidable along the neck strap between respective first positions proximate the midpoint of the neck strap and second positions distal the midpoint of the neck strap to adjust a fit of the garment across an upper back of the wearer and to adjust a spacing between the neck and back straps;

a first continuous adjustable strap attached between first and second portions thereof to the neck strap at the midpoint thereof and slidably attached at respective lower ends of the first and second portions to the back strap on a first side of the midpoint thereof, wherein the respective lower ends of the first and second portions are slidable along the back strap between respective first positions proximate the midpoint of the back strap and second positions distal the midpoint of the back strap to adjust a fit of the garment across the lower back of the wearer and to further adjust the spacing between the neck and back straps; and, a second continuous adjustable strap attached between first and second portions thereof to the neck strap at the midpoint thereof and slidably attached at respective lower ends of the first and second portions to the back strap on a second side of the midpoint thereof, wherein the respective lower ends of the first and second portions are slidable along the back strap between respective first positions proximate the midpoint of the back strap and second positions distal the midpoint of the back strap to adjust a fit of the garment across the lower back of the wearer and to further adjust the spacing between the neck and back straps.

* * * * *